United States Patent [19]

Deutsch et al.

[11] Patent Number: 5,048,806

[45] Date of Patent: Sep. 17, 1991

[54] DOOR HANGING AID

[76] Inventors: Stephen Deutsch, 103 Burwell Street; Thomas D. Peever, 136 Eagle Avenue, both of Brantford, Ontario, Canada

[21] Appl. No.: 548,753

[22] Filed: Jul. 2, 1990

[51] Int. Cl.[5] ..... B25H 1/08

[52] U.S. Cl. ..... 269/152; 269/303; 269/901; 269/904; 269/905

[58] Field of Search ..... 269/904, 905, 901, 152, 269/303; 414/10-11

[56] References Cited

U.S. PATENT DOCUMENTS

| | | | |
|---|---|---|---|
| 741,562 | 2/1903 | Soety | 269/905 |
| 2,503,388 | 4/1950 | Medlund | 269/905 |
| 4,138,099 | 2/1979 | Englehart | 269/905 |
| 4,141,192 | 2/1979 | Augustine | 269/905 |
| 4,257,585 | 3/1981 | Persbeck . | |
| 4,278,249 | 7/1981 | Carter | 269/905 |
| 4,799,658 | 1/1989 | Ponce . | |
| 4,978,132 | 12/1990 | Wilson et al. | 269/905 |

*Primary Examiner*—Robert C. Watson
*Attorney, Agent, or Firm*—Mitches & Co.

[57] ABSTRACT

A collapsible frame is used as a door hanging aid and provides for two articulating U shaped channel members respectively hinged at proximate ends, one to the other together with one of the arms, which moves into a vertical orthogonal position relative to the other arm, which rests on the floor and the vertical arms support two lateral inclined members which stabilizes the unit in a vertical position. The vertical arm also has means to vary the effective width of the vertical channel of that arm so as to accommodate various thicknesses of doors and secure the door therein.

5 Claims, 2 Drawing Sheets

DOOR HANGING AID

This invention relates to a jig, particularly suitable as an aid for altering a door. Specifically, the invention relates to a jig which constrains the door prior to it being mounted on hinges and framed, so that a carpenter might plane the sides and cut or plane the ends of the door, and mount hinges thereon in a convenient fashion and thereafter, hang the door in a frame which has been set to accomodate the door.

BACKGROUND OF THE INVENTION

In the prior art, there is no convenient device which can be picked up and taken from .place to place and from job to job which stabilizes a door adequately so that the sides of the door may be planed or that can be used as a convenient support structure so that the ends of the door may be planed.

According to the prior art, the carpenter makes up several sawhorses and uses these, or other structures or jigs made out of wood so as to hold the door appropriately so that it can be trimmed to size. Once used, the wooden jigs are just thrown away and at another site, a new set of jigs is prepared.

The aforesaid is time consuming and wasteful.

I have conceived of a simple jig, preferably made from extruded aluminum or the like, which collapses and is conveniently carried from place to place, but may be open to stabilize a door into a vertical position so that the sides of the door may be conveniently trimmed as by planing or cutting, and the hinge seats routed or cut and slotted so as to accomodate the hinges, for example, common butt hinges which require recesses to be cut and sized to accomodate the hinge. The ends of the doors may be cut or planed in an alternative application of the hinge since the upper member of the hinge is used as a rest pad to hold one end of the door at an elevated fashion from the other end of the door so that it may be conveniently trimmed.

BRIEF DESCRIPTION OF THE DRAWINGS

The invention will now be described by way of example with reference to the accompanying drawings in which.

DESCRIPTION OF THE PREFERRED EMBODIMENTS

Figure 1:
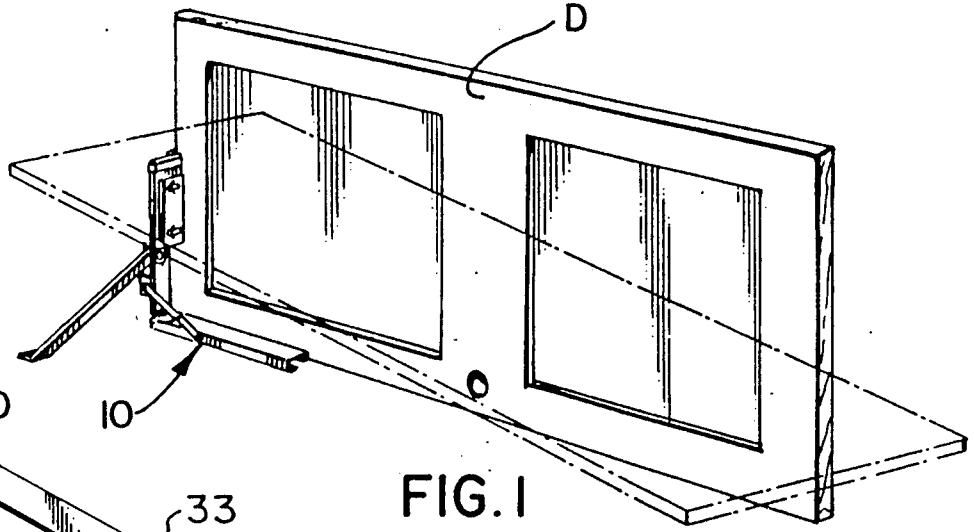
FIG. 1 is a perspective view of the device in use.
Figure 2:
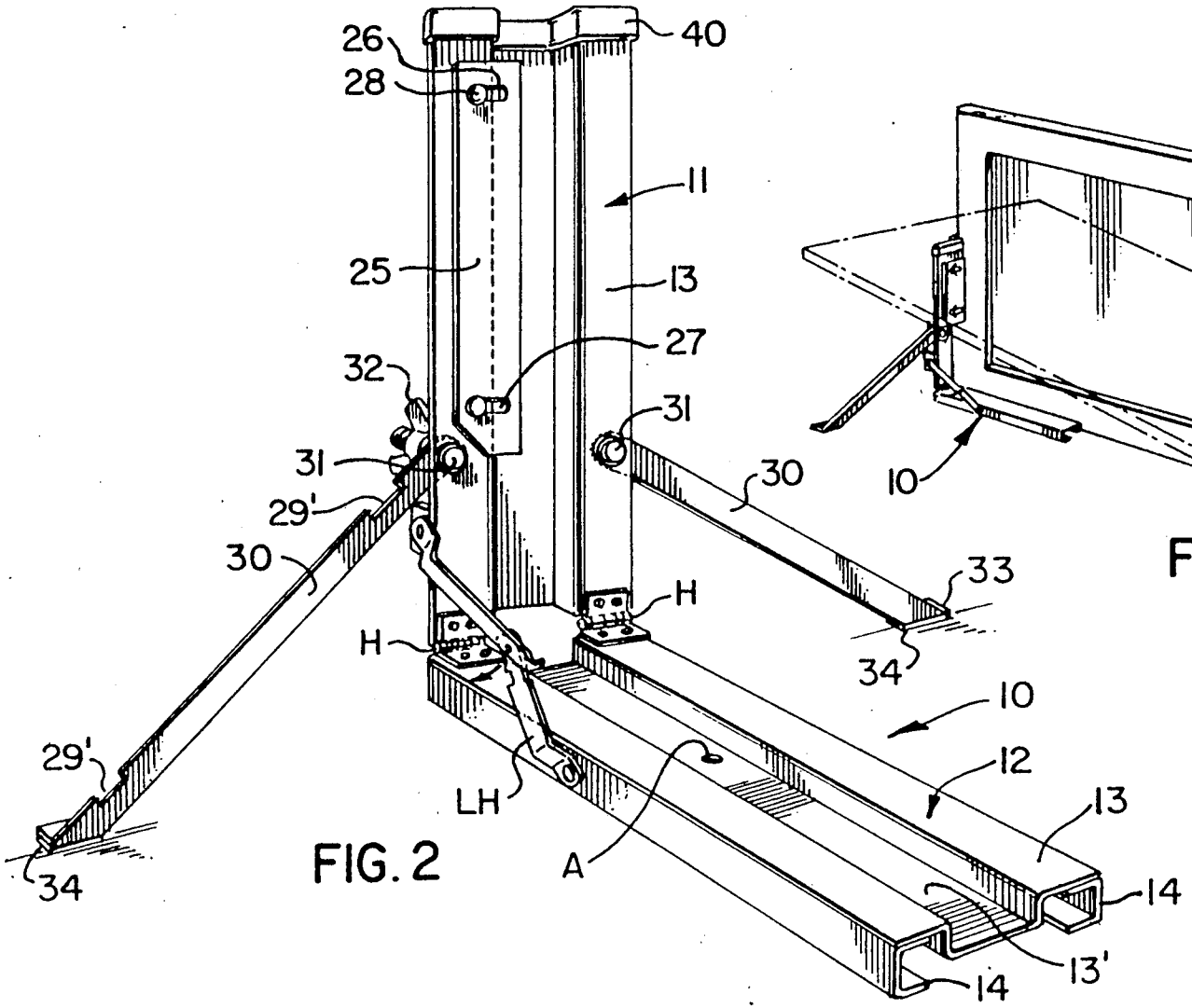
FIG. 2 is a perspective view of the front of the device when opened for use.

Referring to FIG. 1, a door D is held, according to the invention, by a collapsible door hanging aid 10. When in its open position (seen in FIG. 2 without the door).

The door hanging aid 10 consists of two arms 11 and 12, each composed of the extruded U shaped channel member 13 with flanges at the distal ends of the U shape, the lower arm 12 having as well, extruded aluminum U shaped support sides 14 which are attached as by welding, not shown, to the underside of the lateral flange portion of the U shaped extruded members 13. The arms 11 and 12 are interconnected through a pair of hinges H and a lock hinge LH, which when pushed in the direction of the arrow shown in FIG. 2, "locks" the vertical arm 11 into a near orthogonal position preferably at 8° relative to the horizontal arm 12.

The vertical arm 13, in order to provide and accomodate and to secure various thicknesses of doors the same is provided with a movable clamp bar 25 having a rectangular and horizontally oriented upper and lower slots 26 and 27 through which extends a bolt 28 and wing nut 29. By turning down the wing nut 29 on the reverse side of the upright arm 11, the clamping bar 25 is secured against the bottom or top edge of the door, as seen in FIG. 1, and stabilizes the door between the channel arms 11 and 12.

In order to provide lateral stability and to hold the door aid 10 and door D in its upright position for trimming, as seen in FIG. 1, a pair of foldable lateral support arms 30 pivot from a bolt 31 extending through the proximate end of the arm 30 and the flange portion of the vertical arm 11, as seen in the figures, and the same can be bound tight by a wing nut 32.

The distal end of each arm 30 terminates at an incline flat piece or foot 33 into which is fashioned a rubber or resilient gommet or rubber pad 34. The pad 34 provides a resilient and enhanced friction bearing surface for each of the arms. Similarly, strategically located along the bottom margin of each U shaped member 14, are a plurality of spatially disposed pads 34, as more particularly seen in FIGS. 3 and 4. These pads, particularly if they are resilient, protect the finished door should the door have to be removed and retrimmed, which is common when either the door or frame is warped or, because of renovations.

Figure 4:
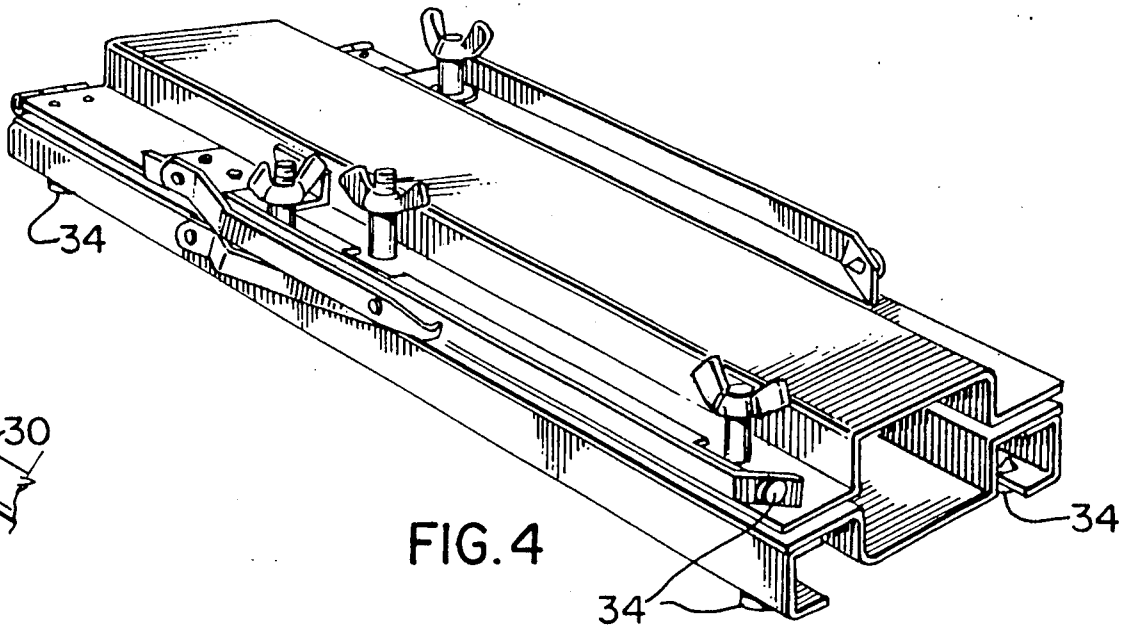
Figure 3:
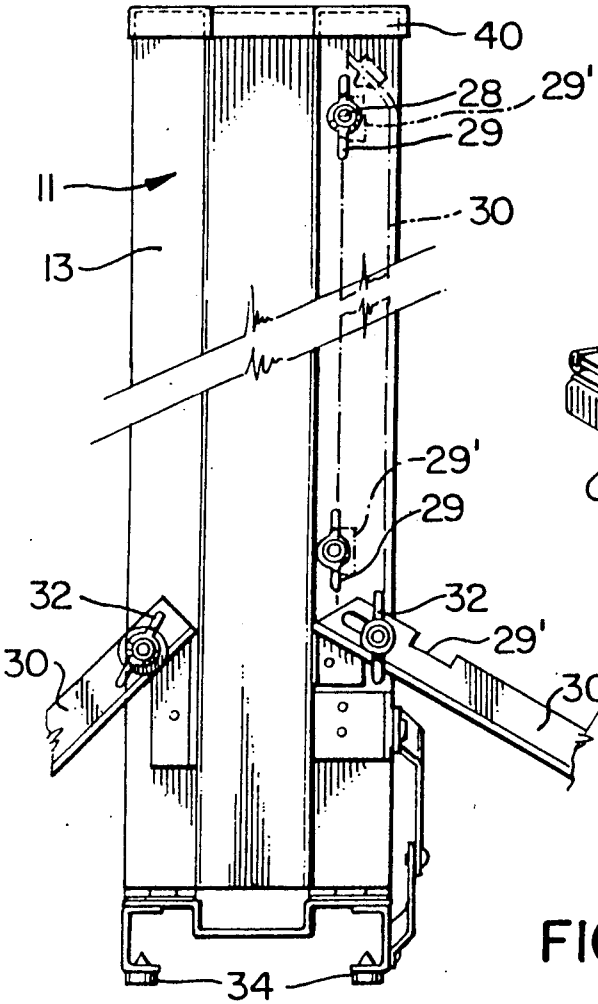
FIG. 3 is a rear elevational view of the device in the open position according to FIG. 2; and, FIG. 4 is a perspective view of the device in its closed position, ready for transport.

The arm 30' next adjacent the stop bar 25, is provided with two bolt accomodating notches 29' so as to allow that arm 30' to collapse into the phantom position shown in FIG. 3 and 4 and to seat around the thumb screw bolts 29.

When the door end is to be trimmed, it can be placed on a top pad 40 so that the door inclines from one end toward the other, as shown in phantom in FIG. 1, and the end of the door whether top or bottom, sawed or planed as may be required.

We claim:

1. A door hanging aid comprising:

(a) a first and a second longitudinal door gripping member, each having a proximate and distal end;

(b) hinge means mounted at the proximate end of each member thereby providing hingeable attachment, with each door gripping member;

(c) releasable lock means adapted to lock the members into an orthogonal operative position and to release them into a collapsed juxtaposed transit position;

(d) stabilizing means carried by the aid adapted to stabilize the same when in the open operative position, so that lateral movement of the aid is inhibited; and, (e) means on one of said members adapted to engage and to constrain a door frame therein.

2. The door hanging aid as claimed in claim 1 wherein the longitudinal members are channel members.

3. The door hanging aid as claimed in claim 1 wherein the longitudinal members are extruded aluminum channel members.

4. The door hanging aid as claimed in claim 1 wherein the releasable locking means is a lock hinge comprising two articulating members, each one having its distal end pivotally attached to one of the said door gripping members and interconnected at a pivot and including a detente and seat adapted to mate one with the other thereby to lock said hinge in the open position.

5. The door hanging aid as claimed in claim 1 wherein each longitudinal door gripping member includes a channel adapted to accommodate a door edge, one of said longitudinal gripping means, including movable abutment means adapted to abut against a portion of the door and to hold the door in said channel, thereby constraining the door.

* * * * *